US007441983B2

(12) United States Patent
Gelfand

(10) Patent No.: US 7,441,983 B2
(45) Date of Patent: Oct. 28, 2008

(54) ENERGY ABSORBING SYSTEM WITH SUPPORT

(75) Inventor: Matthew Gelfand, Rockville Centre, NY (US)

(73) Assignee: Universal Safety Response, Inc., Franklin, TN (US)

( * ) Notice: Subject to any disclaimer, the term of this patent is extended or adjusted under 35 U.S.C. 154(b) by 0 days.

(21) Appl. No.: 11/717,814

(22) Filed: Mar. 13, 2007

(65) Prior Publication Data

US 2007/0160421 A1 Jul. 12, 2007

Related U.S. Application Data

(63) Continuation of application No. 10/726,839, filed on Dec. 2, 2003, now Pat. No. 7,210,873.

(51) Int. Cl.
*E01F 15/00* (2006.01)

(52) U.S. Cl. ..... 404/6; 404/10; 49/9; 49/34

(58) Field of Classification Search ..... 404/6, 404/10; 256/13.1; 244/110 R; 49/9, 34, 49/49, 131

See application file for complete search history.

(56) References Cited

U.S. PATENT DOCUMENTS 1,539,651 A * 5/1925 Donovan ..... 49/9
1,652,186 A * 12/1927 Strauss ..... 49/9
2,088,046 A * 7/1937 White ..... 49/177
2,324,726 A * 7/1943 Sawyer ..... 160/327
5,118,056 A * 6/1992 Jeanise ..... 246/127
5,624,203 A * 4/1997 Jackson et al. ..... 404/6
5,634,738 A * 6/1997 Jackson et al. ..... 404/6
5,823,705 A * 10/1998 Jackson et al. ..... 404/6
6,312,188 B1 * 11/2001 Ousterhout et al. ..... 404/6
6,843,613 B2 * 1/2005 Gelfand et al. ..... 404/6
6,896,443 B1 * 5/2005 Ousterhout et al. ..... 404/6
7,083,357 B2 * 8/2006 Lamore ..... 404/6
7,140,802 B2 * 11/2006 Lamore ..... 404/6
7,195,419 B2 * 3/2007 Gelfand ..... 404/6
7,210,873 B2 * 5/2007 Gelfand ..... 404/6
7,374,362 B1 * 5/2008 Metzger ..... 404/6

OTHER PUBLICATIONS

Supplementary European Search Report, Jul. 24, 2008, European Patent Office "the whole document".

* cited by examiner

*Primary Examiner*—Gary S Hartmann
(74) *Attorney, Agent, or Firm*—Milbank, Tweed, Hadley & McCloy LLP

(57) ABSTRACT

An energy absorbing system. The system includes two anchors, a net mechanically coupled thereto and spanning a roadway, and a first raising/lowering arm arranged on one side of the roadway. The first raising/lowering arm mechanically coupled to and supporting an upper portion of the net via a first upper frangible tensioner and mechanically coupled to and supporting a lower portion of the net via a first lower frangible tensioner. A second raising/lowering arm arranged on another side of the roadway, the second raising/lowering arm mechanically coupled to and supporting an upper portion of the net via a second upper frangible tensioner and mechanically coupled to and supporting a lower portion of the net via a second lower frangible tensioner. The first and second upper and first and second lower frangible tensioners decouple from the net upon application of a predetermined force.

5 Claims, 13 Drawing Sheets

ENERGY ABSORBING SYSTEM WITH SUPPORT

This application is a continuation of U.S. patent application Ser. No. 10/726,839, filed Dec. 2, 2003, now U.S. Pat. No. 7,210,873, which is hereby incorporated by reference.

BACKGROUND

This invention relates to an energy absorbing system with a support where the system can be used to dissipate unwanted energy such as, e.g., the energy of an errant vehicle. The system may be used in a variety of applications, including HOV lane traffic control, drawbridges, security gates, or crash cushion applications. In one application, the system may be used to prevent a vehicle from crossing a railroad track while the warning gates are down or there is a train in the area.

SUMMARY OF THE DISCLOSURE

The present disclosure relates to an energy absorbing system. In one embodiment, the energy absorbing system includes a first anchor and a second anchor, located on opposite sides of a roadway, a net mechanically coupled to each of the first and second anchors and spanning the roadway, a first raising/lowering arm arranged on one side of the roadway, the first raising/lowering arm mechanically coupled to and supporting an upper portion of the net via a first upper frangible tensioner and mechanically coupled to and supporting a lower portion of the net via a first lower frangible tensioner, a second raising/lowering arm arranged on another side of the roadway, the second raising/lowering arm mechanically coupled to and supporting an upper portion of the net via a second upper frangible tensioner and mechanically coupled to and supporting a lower portion of the net via a second lower frangible tensioner, wherein the first and second upper and first and second lower frangible tensioners decouple from the net upon application of a predetermined force.

DETAILED DESCRIPTION

The energy absorbing system in one aspect may comprise an anchor or other mechanism for providing a fixed point, for example, a stanchion, one or more energy absorbing mechanisms coupled to the anchor for absorbing forces, a restraining capture net or other barrier coupled to one or more the energy absorbing mechanisms, and a support or other mechanism for supporting the restraining capture net or other barrier. In another aspect, the restraining capture net or other barrier may be coupled to the anchor without an energy absorbing mechanism between the restraining capture net and stanchion.

In another aspect, the support may be attached to the restraining capture net or other barrier via a frangible breakaway mechanism which breaks and thereby decouples the support and the restraining capture net in response to tensile forces that meet or exceed a minimum threshold force. In one aspect, it is envisioned that static tension from the restraining capture net in its quiescent state would not exceed this minimum threshold force, but that increased tension due to the dynamic forces exerted upon the frangible breakaway mechanism from a vehicle driving into the restraining capture net would exceed this minimum threshold force.

In another aspect, the support may be attached to the restraining capture net via a non-frangible connector and the support may be disturbed by the impact of the vehicle, or the non-frangible connector may expand or extend. In another aspect, the support may include a frangible or releasable portion, for example, a post, which decouples the support from the net in response to a minimum threshold force. In another aspect, the support may include a retractable mechanism for supporting the restraining capture net from above.

In yet another aspect, the support may be raised and lowered, thereby raising and lowering the restraining capture net or other barrier which it supports.

The energy absorbing mechanism may be mounted for rotation about the axis and be expandable in a direction substantially orthogonal to the axis. In another aspect, the energy absorbing mechanism may be a shock absorber, braking mechanism, or other friction damper, and may include a securing mechanism such that an expandable section of the energy absorbing mechanism, for example, a piston, does not expand except in response to tensile forces that meet or exceed a minimum threshold force. In one aspect, the static tension from the restraining capture net in its quiescent state will not exceed this minimum threshold force, and increased tension due to the dynamic tensile forces exerted upon the shock absorber from a vehicle driving into the restraining capture net would exceed this minimum threshold force.

Figure 1:
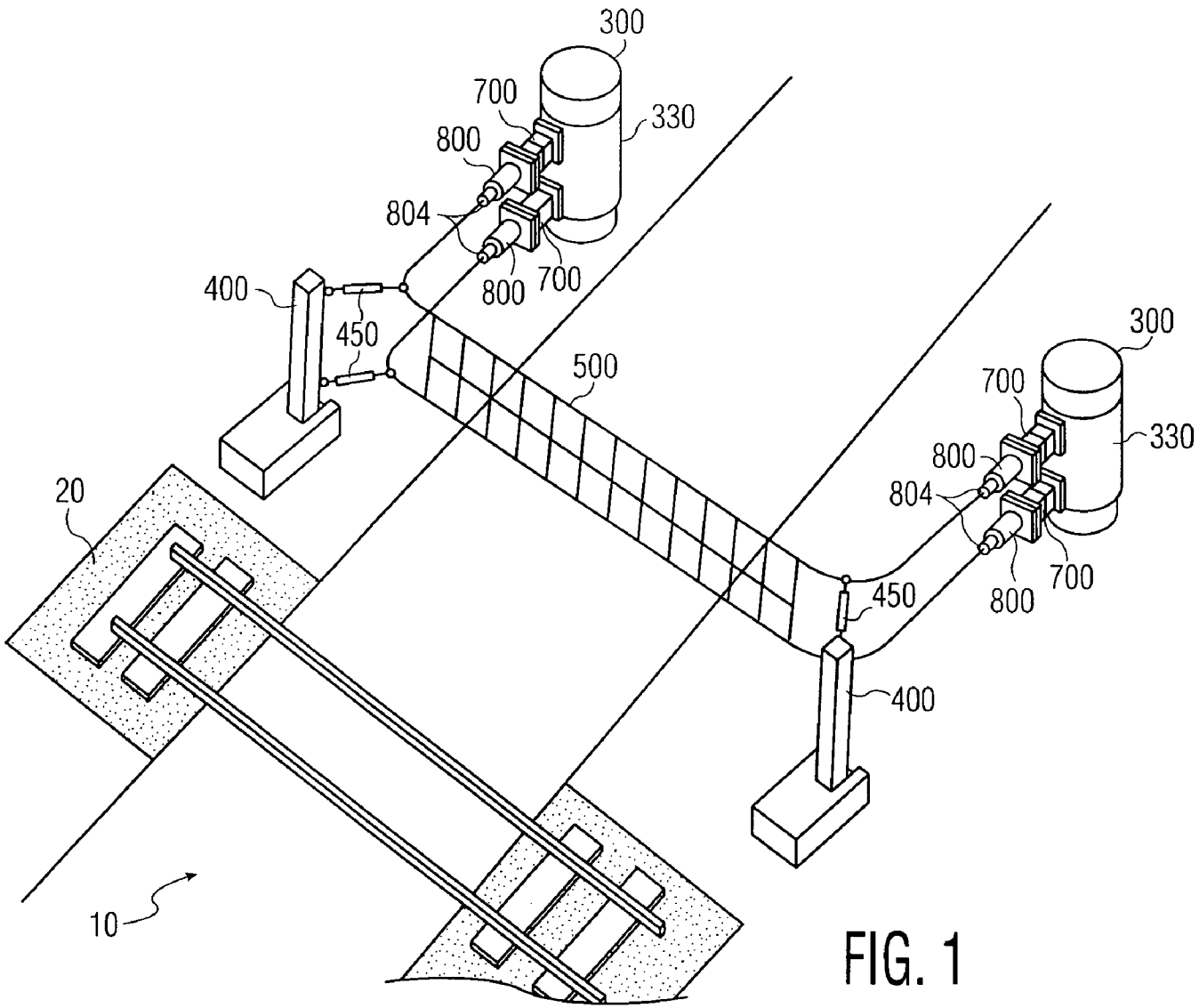
FIG. 1 is a perspective view which illustrates an energy absorbing system with support arranged at a railroad crossing of a single-lane roadway according to one aspect of the system of the present disclosure.

Referring to the drawings, wherein like reference numerals represent identical or corresponding parts throughout the several views, and more particularly to FIG. 1, a general layout of an embodiment according to one aspect of the system of the present disclosure is shown installed at a railroad crossing. A roadway is indicated generally by reference numeral 10 and railroad tracks are indicated generally by reference numeral 20. A capture net 500 is stretched across roadway 10 parallel to tracks 20. Capture net 500 extends between anchors, for example, stanchions 300, and supports 400 located on opposite sides of roadway 10. The capture net 500 may be coupled at each end to a braking mechanism, for example, shock absorbers 800 which in turn may be coupled to a joint 700, which may be coupled to a bearing sleeve 330 surrounding stanchion 300, as described in greater detail below.

In FIG. 1, the shock absorbers 800 are substantially parallel to roadway 10, and shock absorber pistons 804 are in a compressed state. In this aspect, the supports 400 are arranged with respect to stanchions 300 in a manner such that, on impact, the pistons 804 may extend in a direction substantially the same as the direction in which the vehicle 30 is traveling.

The capture net 500 may be coupled to supports 400 via a breakaway connector 450. The supports 400, which may be raised and lowered, are shown in a raised position in FIGS. 1 and 2. When supports 400 are lowered, the capture net 500 may rest in a position such that vehicles may drive over the capture net 500 unimpeded. In another aspect, when supports 400 are lowered, capture net 500 may be tucked into, for example, a slot cutout spanning roadway 10, and having sufficient depth and width to accommodate some or all of the capture net 500; such a cutout may be incorporated into a speed-bump.

Figure 2:
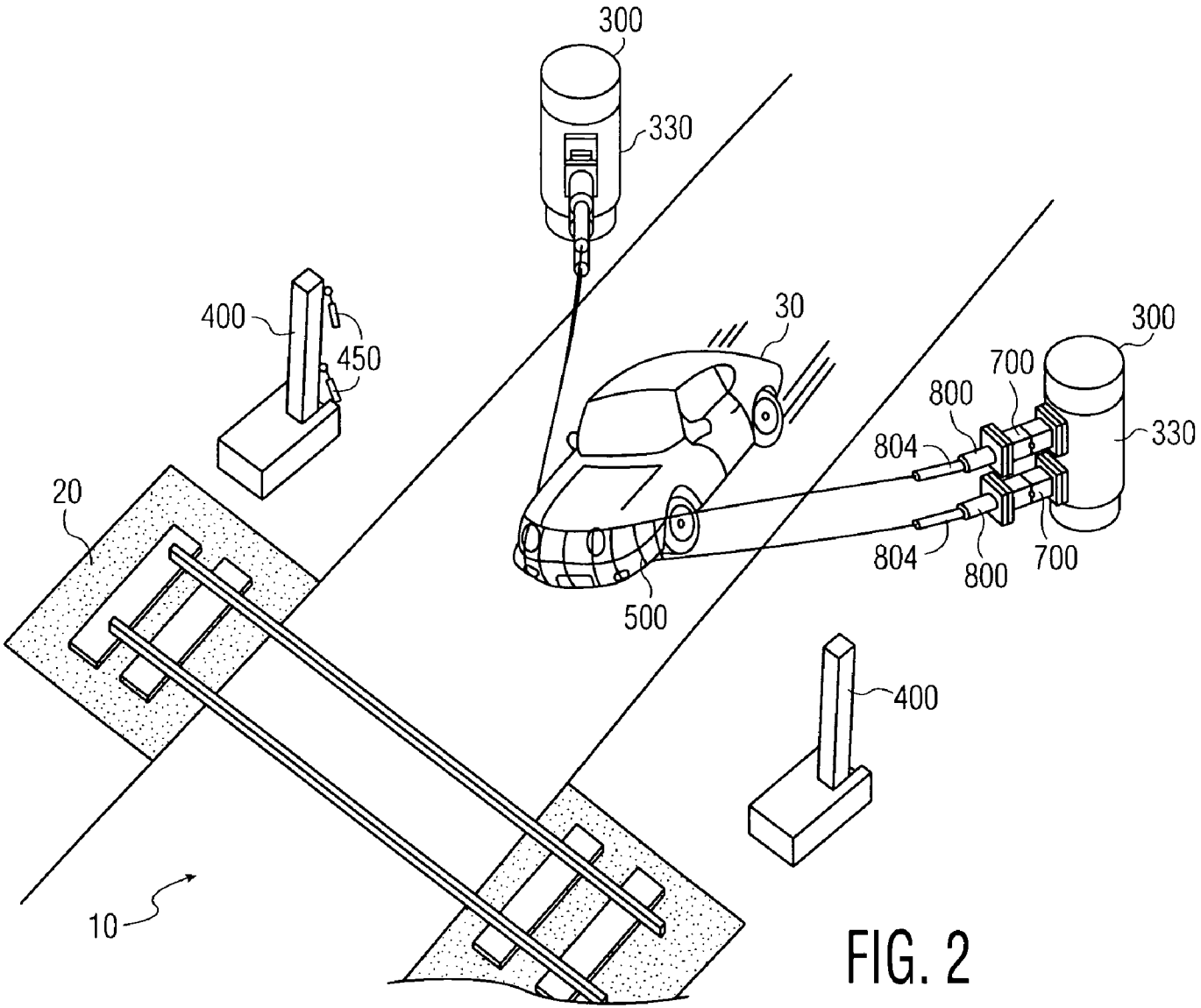
FIG. 2 is a perspective view which illustrates an energy absorbing system with support arranged at a railroad crossing of a single-lane roadway and restraining a vehicle according to one aspect of the system of the present disclosure.

Shown at the top of FIG. 2 is a vehicle 30 which has crashed into capture net 500 and is restrained by capture net 500 to prevent it and its occupants from encroaching onto tracks 20. Capture net 500 has been deflected by the collision from its quiescent state so as to form a shallow "V" shape. Bearing sleeve 330 has rotated about stanchion 300 and shock absorbers 800 are now pointed inward toward roadway 10, with shock absorber pistons 804 no longer in a compressed state. Joints 700 may pivot vertically depending on certain factors such as, for example, the height of the vehicle impact with capture net 500. Further, breakaway connectors 450 have been severed, and, therefore, supports 400 no longer support capture net 500.

The ability of capture net 500 to be deflected, yet provide a restraining force, allows vehicle 30 to be progressively stopped, thereby lessening adverse effects of the impact forces acting on vehicle 30 and its occupants. The deflecting and restraining functions are achieved by a unique energy absorbing system, described in greater detail below.

Figure 3A:
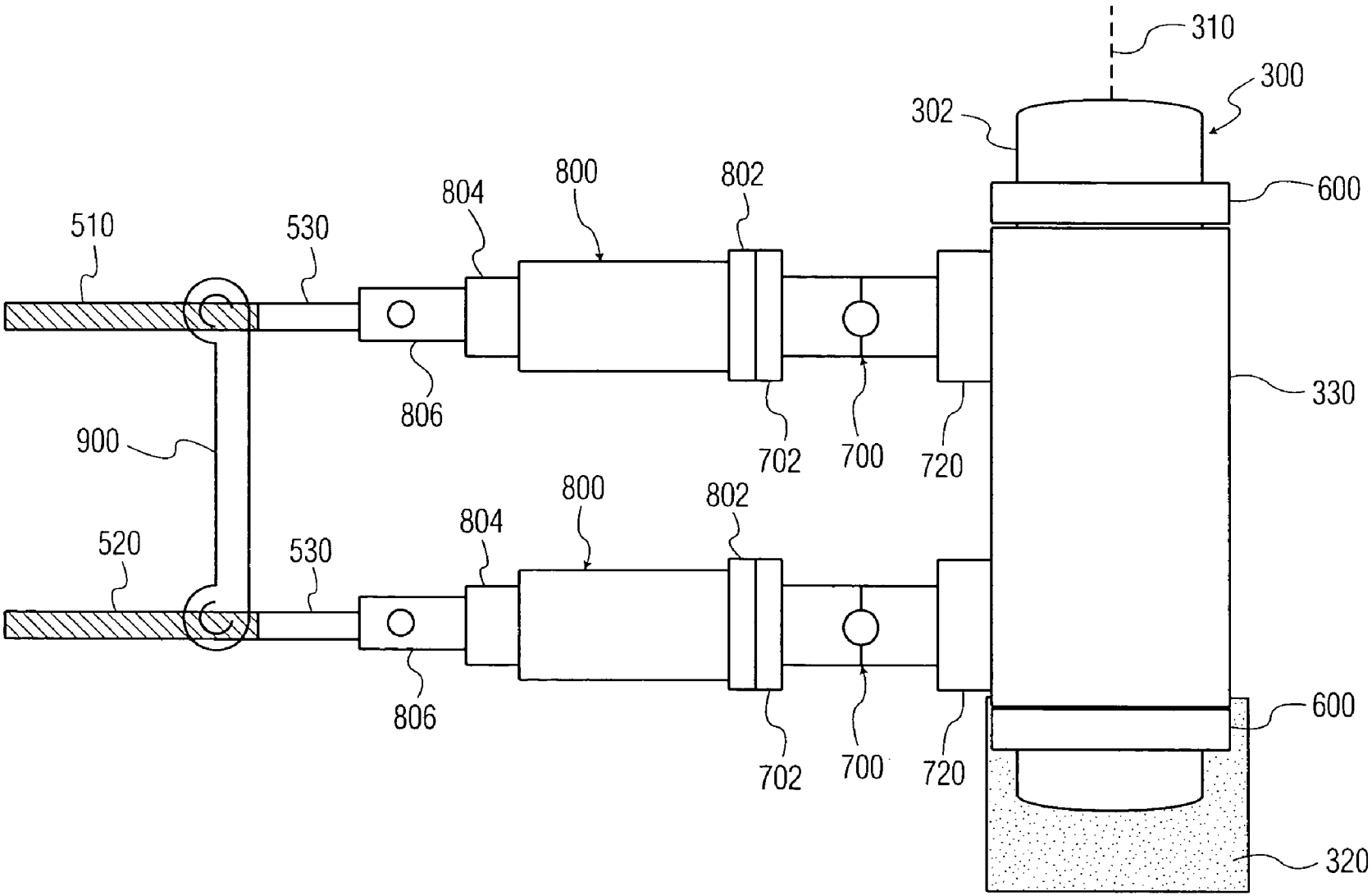
FIG. 3A is a side view of a stanchion, joint, shock absorber and capture net according to one aspect of the system of the present disclosure.

FIG. 3A is a side view of a stanchion, joint, shock absorber and capture net according to one aspect of the system. Stanchion 300 may include a pipe 302, which may be reinforced by inserting, a bar or other support (not shown) therein, may be filled with concrete (not shown) and embedded into a concrete base 320, which has been poured into the ground. Stanchion 300 has an axis 310, which may be a vertical axis, whose function will become clear hereinafter.

The system of the present disclosure may also include a bearing sleeve 330 fitted around stanchion 300 and which may be rotatable about stanchion 300. Bearing sleeve clamps 600 fitted around stanchion 300 may be used to prevent bearing sleeve 330 from sliding vertically on stanchion 300. Bearing sleeve 330 and bearing sleeve clamps 600 may be fabricated from pipe having approximately the same inner diameter as the outer diameter of stanchion 300.

Figure 6A:
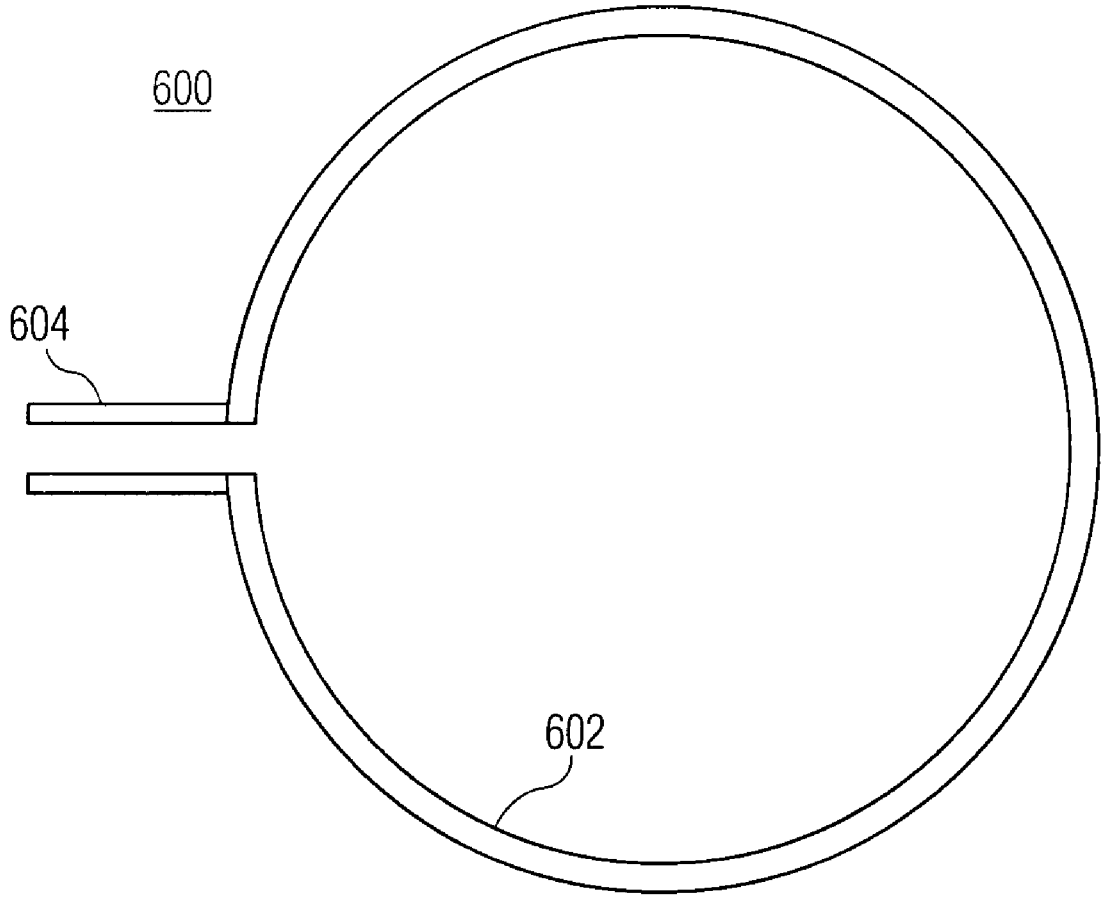
FIG. 6A is a top view of a bearing sleeve clamp according to one aspect of the system of the present disclosure.
Figure 6B:
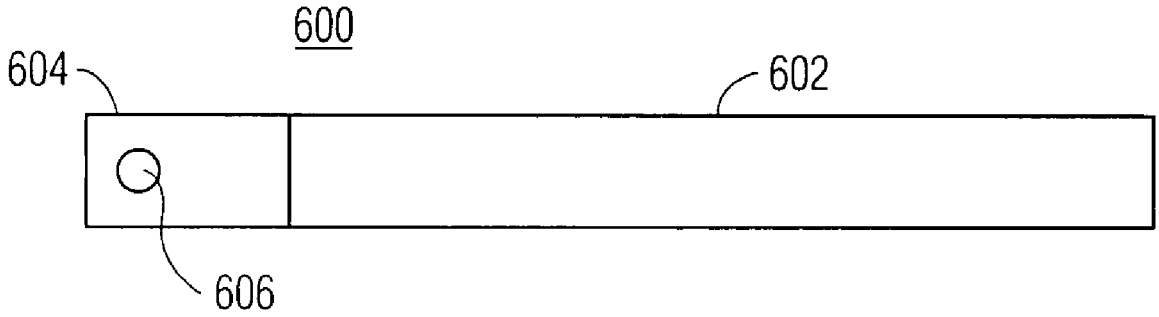
FIG. 6B is a side view of a bearing sleeve clamp according to one aspect of the system of the present disclosure.

An example of a bearing sleeve clamp 600 according to one aspect of the system of the present disclosure is shown in FIGS. 6A (top view) and 6B (side view). As shown in FIGS. 6A and 6B, bearing sleeve clamp 600 may include a sleeve clamp ring 602 attached to a sleeve clamp flange 604 for securing about stanchion 300. Sleeve clamp flange 604 may contain one or more holes 606 for accommodating one or more bolts or other securing mechanisms.

Returning to FIG. 3A, stanchion 300 may be coupled to capture net 500 via shock absorber 800 and joint 700. Accordingly, cable ends 530 of top cable 510 and bottom cable 520 may be coupled to piston connectors 806, using a pin or other mechanism. Shock absorber 800 may have a shock absorber flange 802 which may be secured using bolts to joint front flange 702. Joint rear flange 720 may be secured to bearing sleeve 330, by a weld, bolts or other means to a bearing sleeve flange (not shown) coupled to bearing sleeve 330. Alternatively, joint 700 may be omitted, with shock absorber flange 802 secured to bearing sleeve 330, by a weld, bolts or other suitable means. to the bearing sleeve flange.

In another aspect, a crossbar 900 may be attached vertically between two or more cables, joints 700, or shock absorbers 800 arranged on a stanchion 300. The crossbar 900 may alleviate vertical torque on the cables, joints 700 and shock absorbers 800, which might otherwise occur due to the fact that a vehicle 30 colliding with the capture net 500 may cause the top cable 510 and bottom cable 520 and, therefore, the joints 700 and shock absorbers 800 connected thereto, to tend to squeeze together. Thus, the crossbar 900 may act as a stabilizer against this vertical torque. The crossbar 900 may also cause top and bottom pistons 804 to expand with increased uniformity upon impact by vehicle 30. In one aspect, the crossbar 900 may be formed of a rigid material such as, for example, steel or other hard metal. In another aspect, crossbar 900 may be constructed of non-rigid material, for example, cable.

Figure 3B:
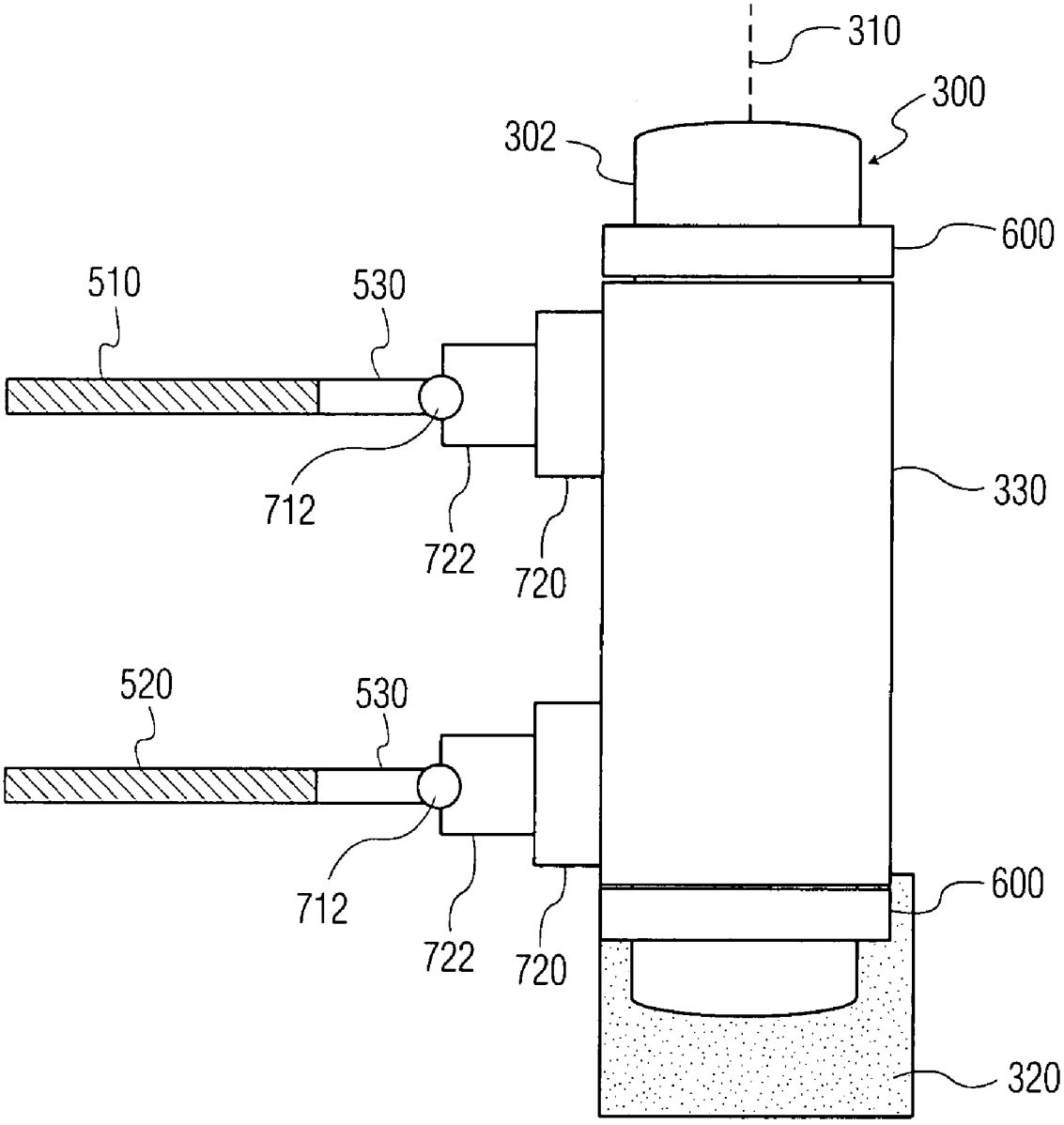
FIG. 3B is a side view of a stanchion and capture net according to one aspect of the system of the present disclosure.

FIG. 3B shows a side view of a stanchion and capture net according to another aspect of the system of the present disclosure. In this aspect, shock absorbers 800 are not present, and cable ends 530 may be coupled to the stanchion 300 or bearing sleeve 330. In other aspects, cable ends 530 may be coupled to joint front flange 702, or joint inner prongs 722 using pin 712. In each of these aspects, because shock absorbers 800 are not present, vehicle 30 will come to a halt in a shorter distance with greater deceleration. In these aspects, capture net 500 may be constructed of cable having a greater strength than in a system in which shock absorbers 800 are present.

Figure 4A:
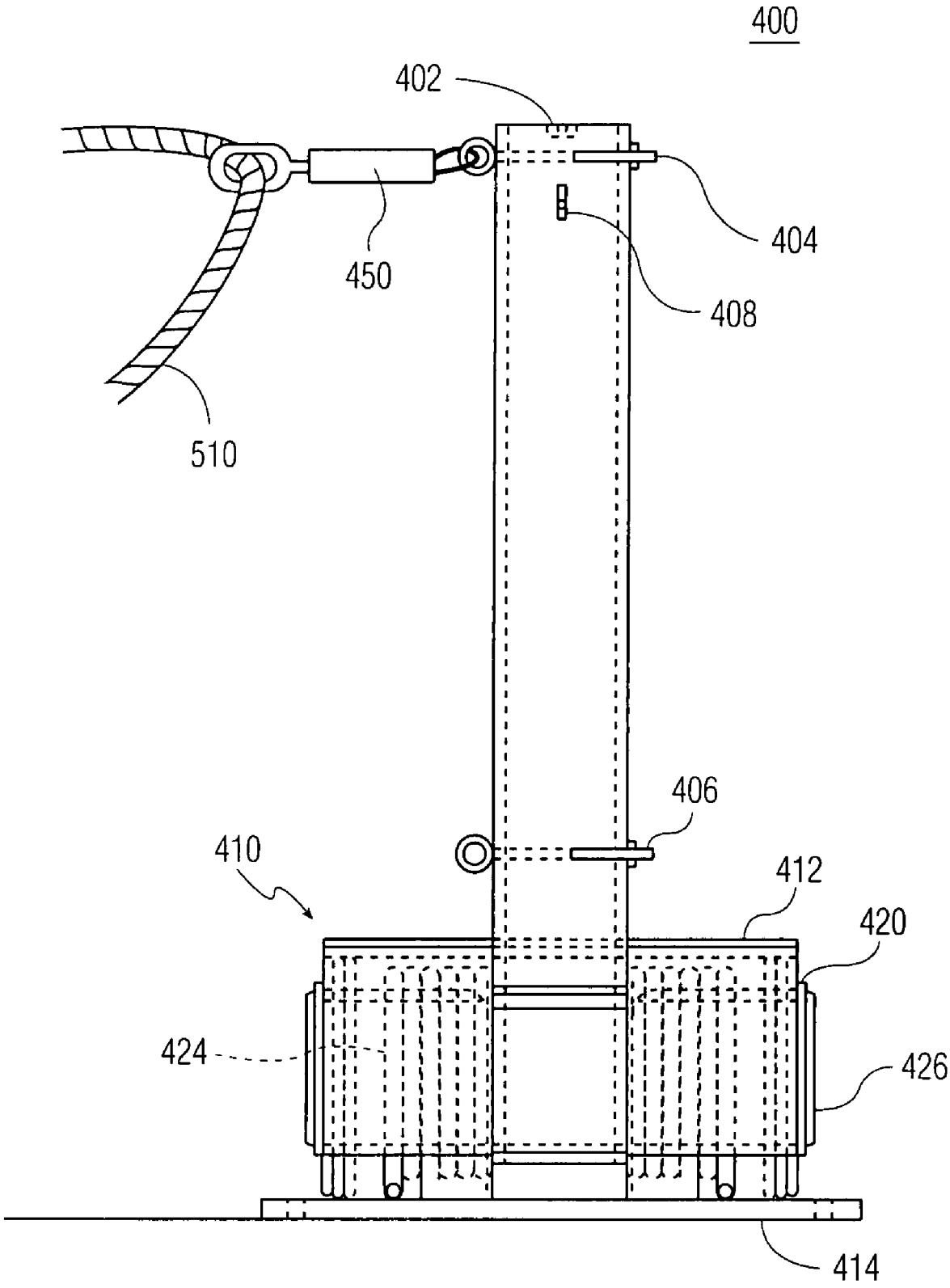
FIG. 4A is a front view of a support, breakaway device and capture net according to one aspect of the system of the present disclosure.
Figure 4B:
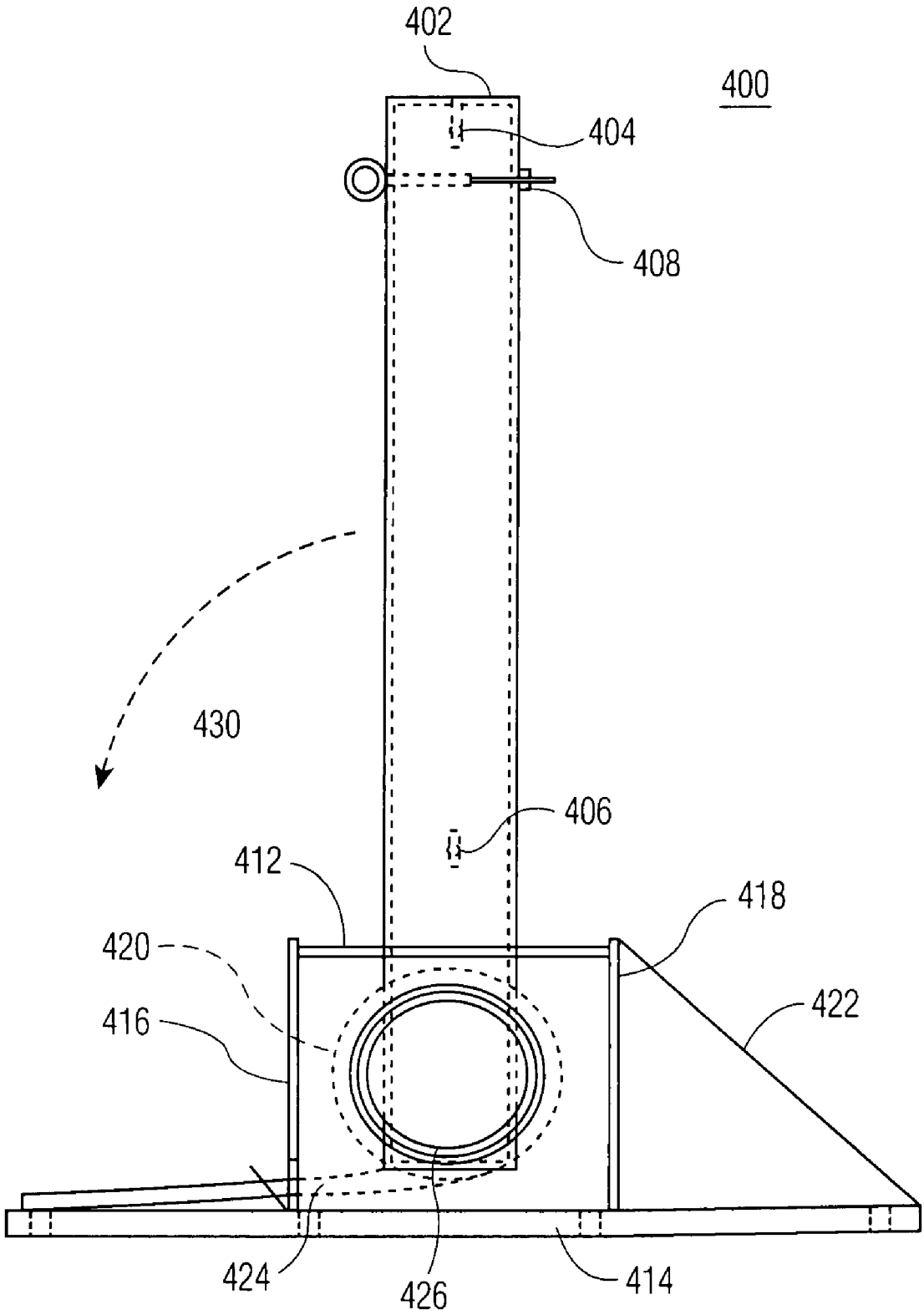
FIG. 4B is a side view of a support according to one aspect of the system of the present disclosure.

FIGS. 4A (front view), 4B (side view) and 4C (side view) show a support 400 according to one aspect of the system of the present disclosure. As shown in FIGS. 4A and 4B, the support 400 may include a post 402, which may include top cable securing point 404 for attaching, for example, a breakaway connector 450 to top cable 510, and bottom cable securing point 406 for attaching, for example, a breakaway connector 450 to bottom cable 520.

Post 402 may be inserted into a spool 426 around which a spring 424 is coiled in a manner such that in the spring's uncompressed state, post 402 is in an upright, vertical position as shown in FIGS. 4A and 4B. Post 402 may pivot with the spool 426 in the direction shown by arrow 430. Spring 424 and spool 426 may be encased in housing 410 which may include top plate 412, base plate 414, and side plates 420, as well as back plate 418 and back support 422. Post 402 may also include securing point 408 which may be used by a raise-lowering mechanism (not shown). Post 402 may also include a hook or other device (not shown) for connecting to a latching mechanism which may be placed on the ground or incorporated as part of an extension of housing 410 and which secures the post 402 when the spring 424 is in a compressed state.

In another aspect, a levered system or a powered drive system, for example, an electric motor, located within or external to housing 410 may be used in place of the spring-based system described above.

Figure 4C:
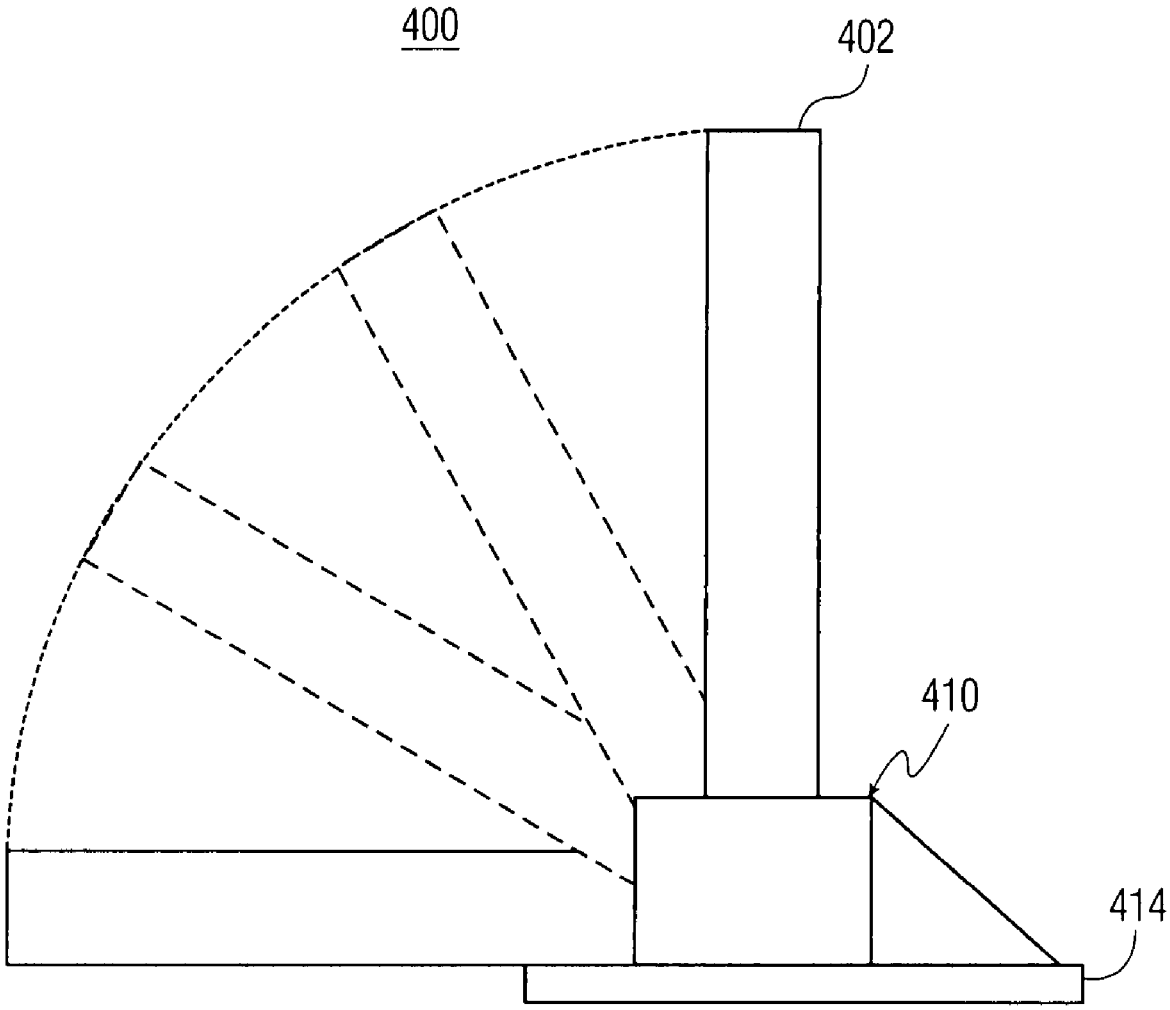
FIG. 4C is a side view of a support according to one aspect of the system of the present disclosure.

As shown in FIG. 4C, post 402 may have a raised and lowered position. Support 400 may be positioned such that, in the lowered position, the distal end of post 402, i.e. that end not in contact with spool 426, is pointed in the direction of oncoming vehicle 30.

As described above, breakaway connector 450 disconnects the support 400 and the capture net 500 in response to forces that meet or exceed a minimum threshold force. In one aspect, static tension from the capture net 500 in its quiescent state would not exceed this minimum threshold force, but increased tension due to the dynamic tensile forces exerted upon the breakaway connector 450 from a vehicle 30 driving into the capture net 500 would exceed this minimum threshold force.

An eyebolt-turnbuckle-cable-clamp combination may be used to couple support 400 to capture net 500 and act as breakaway connector 450. The eyebolt may connect to top cable securing point 404. The eyebolt then may be coupled to an adjustable turnbuckle which may control the height and/or tension of capture net 500 when the support 400 is in the upright position. The other end of the adjustable turnbuckle may by coupled to a cable, for example, a 5/16 inch cable, which couples to a cable clamp attached to capture net 500. It may be expected that at least the 5/16 inch cable will break, thereby disconnecting turnbuckle and cable clamp, when the minimum threshold force is exceeded. It will be apparent to one skilled in the art that, according to this aspect of the system of the present disclosure, the type, style and thickness of breakaway connector 450 used will depend on a number of factors, including, but not limited to, the type of capture net 500 and the amount of static tension applied to capture net 500 in its quiescent state.

Breakaway connector 450 and surrounding equipment may also include one or more of the following, alone or in combination: a turnbuckle, cable, come-along, bolt, or other frangible connection device. It will be apparent to one skilled in the art that a mechanism may be used for both its tensioning and frangible properties.

The raise-lowering mechanisms controlling post 402 may be under the control of a standard train-detecting system, such as is commonly used to control gates at railroad crossings. In operation, a control system (not shown) may sense the presence of an oncoming train and may thereby control capture net operations. In addition to railroad crossings, the system can also be used in a variety of other applications, including HOV lane traffic control, drawbridges, security gates, or crash cushion applications. One can readily appreciate that the control system for such applications may differ from that used in a railroad crossings. At security gates, for example, the capture net 500 may be in a raised position, and actuation of the security system (e.g., by a guard, a key card, keyboard punch, etc.) would lower the barrier and permit passage. In another application, the capture net 500 may be in a lowered position and raised when warranted, for example, in an emergency.

In another aspect, the support 400 may be attached to the restraining capture 500 net via a non-frangible connector. In this aspect, the non-frangible connector will not uncouple the support 400 from the capture net 500 in response to the threshold force. In one such aspect, the support 400 may be disturbed by the impact of the vehicle 30. In another aspect, the support 400 may be integrated into the net 500. In another aspect, the non-frangible connector may expand or extend in response to a threshold force. In another aspect, the non-frangible connector may compress in response to a threshold force.

In yet another aspect, the support 400 may include a frangible or releasable portion, for example, the post 402 may decouple the support 400 from the capture net 500 in response to a minimum threshold force.

In another aspect, the support 400 may include a retractable mechanism (not shown) for supporting the restraining capture net 500 from above.

Figure 5:
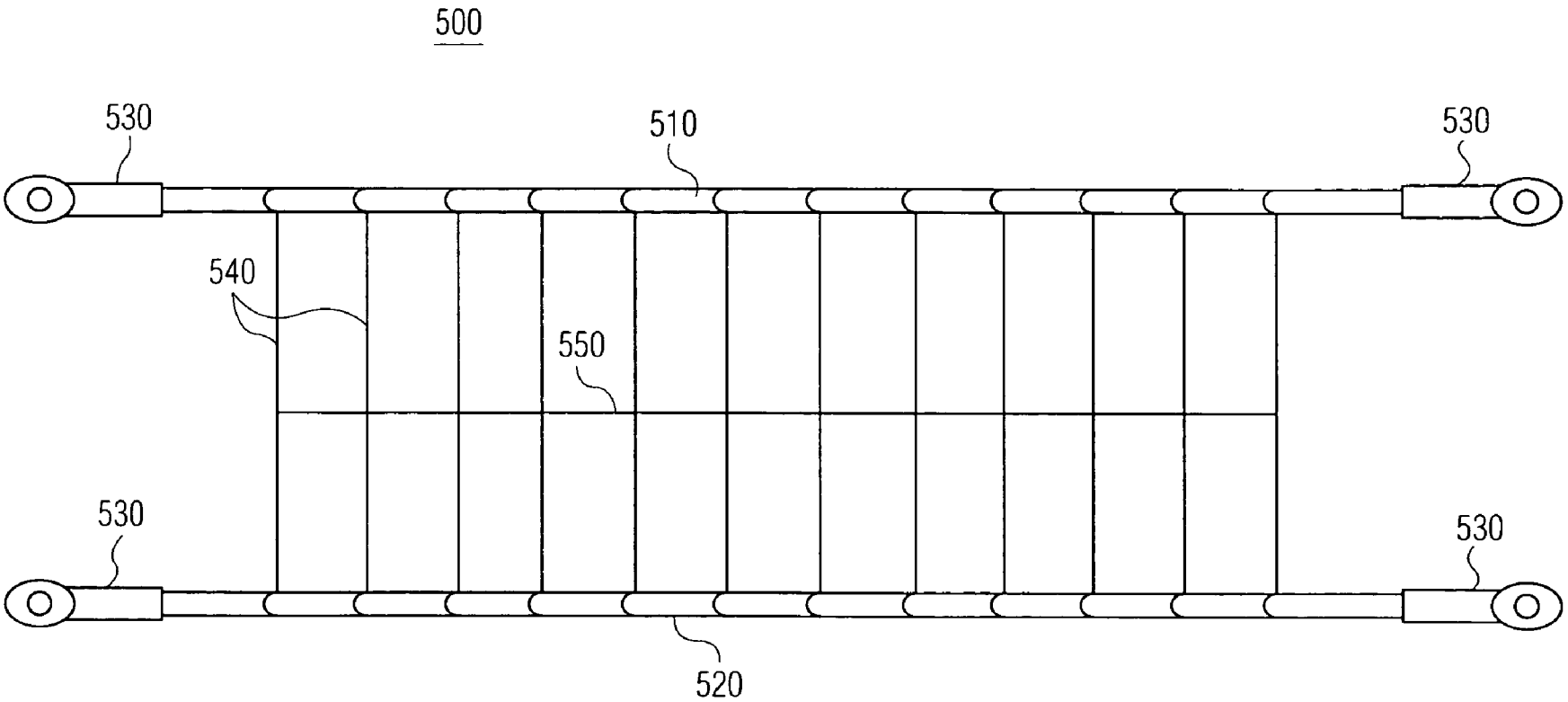
FIG. 5 is a front view of a capture net according to one aspect of the system of the present disclosure.

FIG. 5 shows a capture net 500 which includes a top cable 510 and bottom cable 520, each having cable ends 530, where the top cable 510 and bottom cable 520 may be coupled by a number of vertical cables 540. The vertical cables 540 may be coupled by a center cable 550.

Vertical cables 540 may be coupled to center cable 550, for example, by using a u-bolt, or the two may be interwoven. In another aspect of the system of the present disclosure, the vertical cables 540 may be, for example, woven into the top cable 510 and bottom cable 520. Other suitable nets may be used.

Figure 7A:
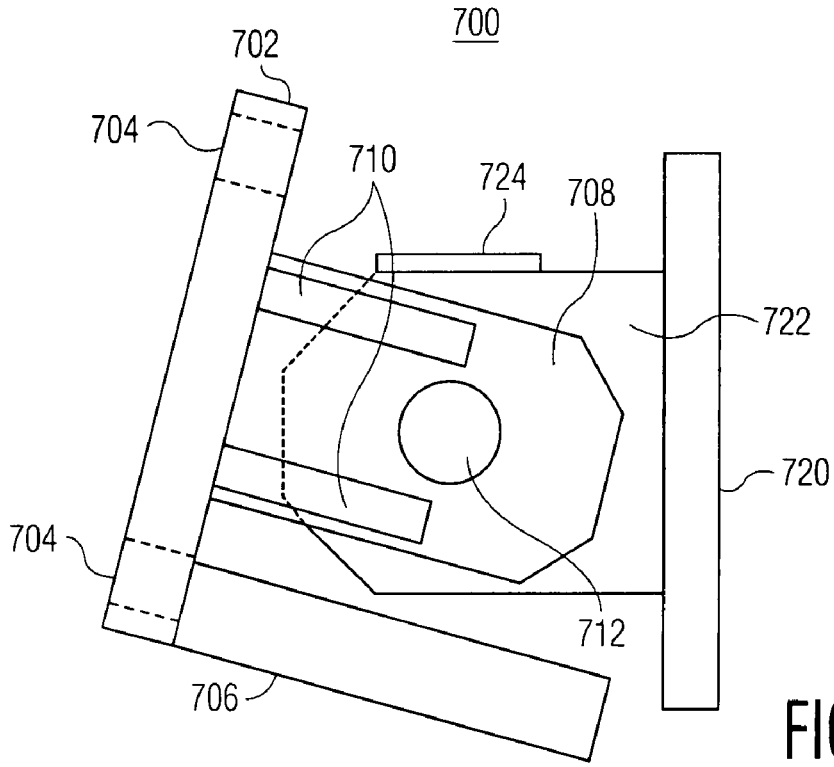
FIG. 7A is a side view of a joint according to one aspect of the system of the present disclosure.
Figure 7B:
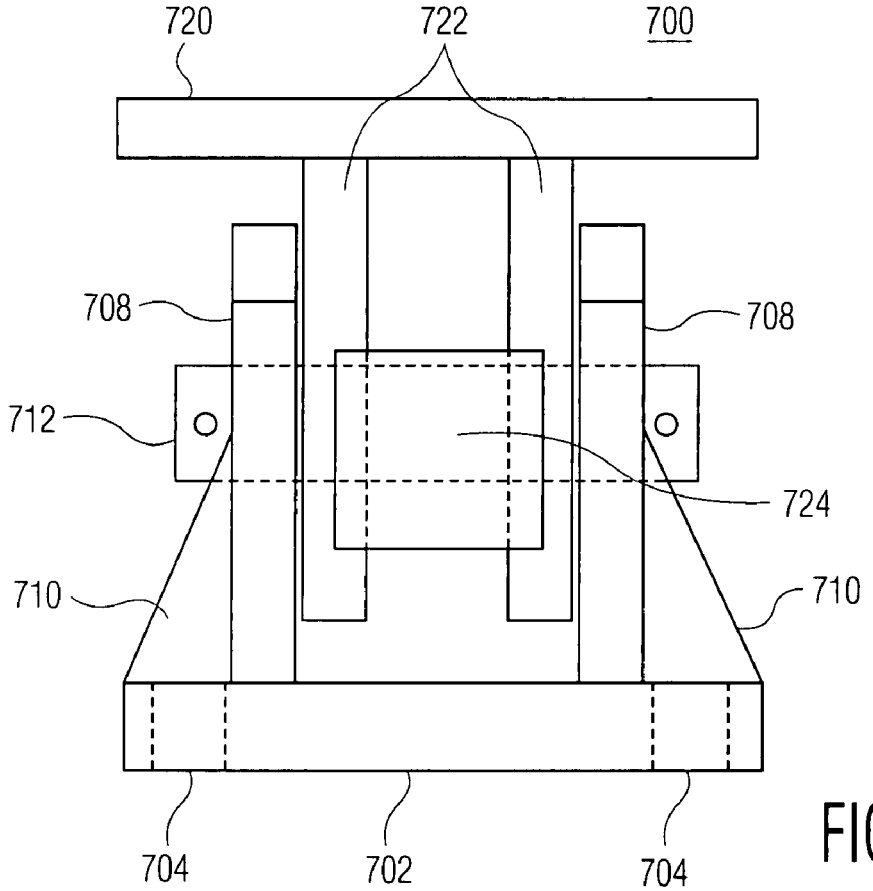
FIG. 7B is a top view of a joint according to one aspect of the system of the present disclosure.

FIGS. 7A and 7B show side and top views, respectively, of joint 700 according to one aspect of the system of the present disclosure. A prong stop plate 706, may make contact with joint rear flange 720 to support the weight of the capture net 500 and shock absorber 800 and may prevent joint front flange 702 from pivoting downward beyond a predetermined level, for example, a horizontal level. Joint outer prongs 708 may be supported by joint outer prong supports 710 which attach to joint front flange 702 and fit on either side of joint inner prongs 722. Joint inner prongs 722 attach to joint rear flange 720 and may be supported by joint inner prong support 724. Joint outer prongs 708 and joint inner prongs 722 may be rotatably fixed using a pin 712, thereby allowing shock absorber 800 to pivot on a vertical plane. Joint front flange 702 may have bolt holes 704 for securing to shock absorber flange 802.

Figure 8A:
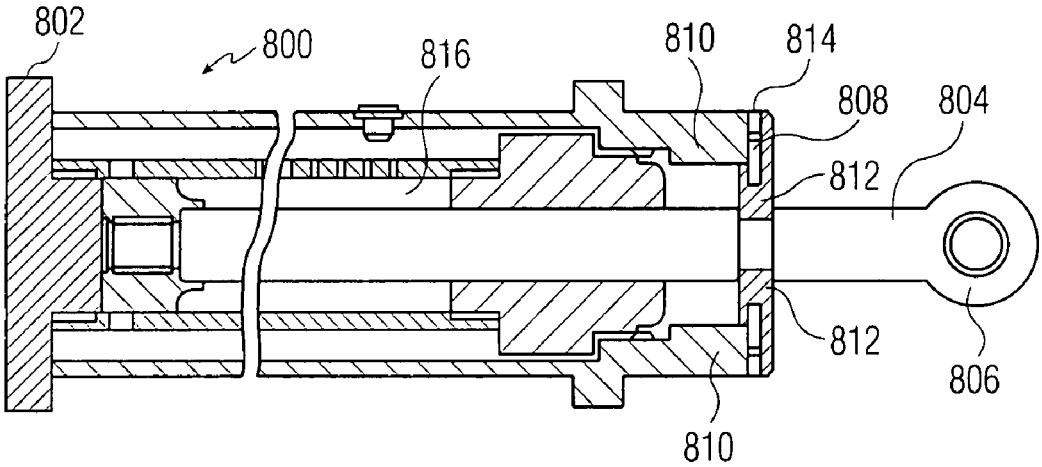
FIG. 8A is a side view of a shock absorber in a compressed state according to one aspect of the system of the present disclosure.
Figure 8B:
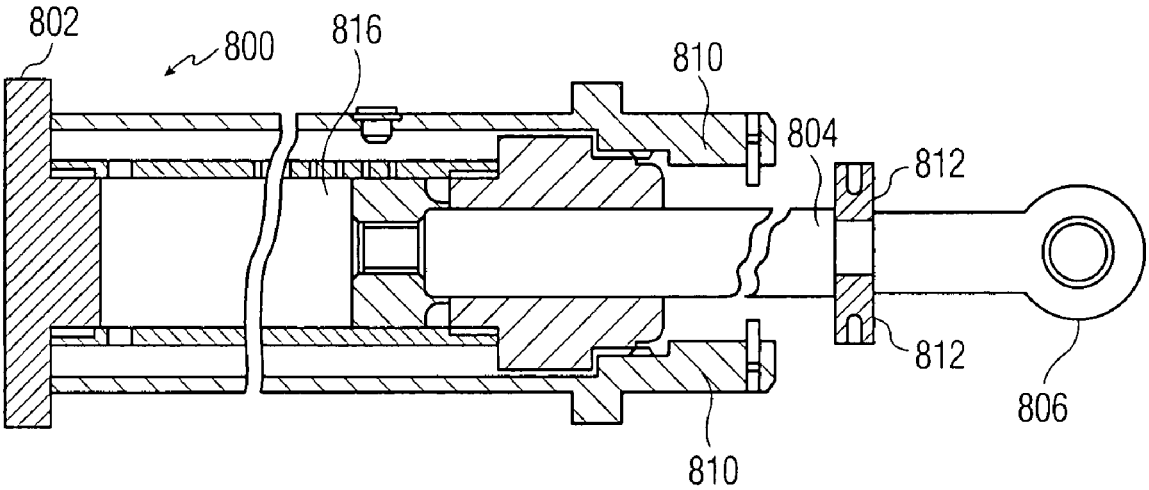
FIG. 8B is a side view of a shock absorber in an expanded state according to one aspect of the system of the present disclosure.

FIGS. 8A and 8B show a side view of a shock absorber in a compressed state and expanded state, respectively. Shock absorber 800 has shock absorber flange 802 which may couple to joint front flange 702.

Shock absorber piston 804 may be removably attached to capture net 500 via a piston connector 806, which may be an eyelet extension, through which a cable, clamp or other appropriate securing mechanism may be passed in order to secure the cable end 530 to the shock absorber piston 804.

Prior to vehicle 30 colliding with capture net 500, shock absorber 800 may be in a compressed state and may be secured by a threshold force securing mechanism. The threshold force securing mechanism may be capable of withstanding a predetermined threshold tensile force. In one aspect, a threshold force securing mechanism includes one or more shear pins 808 which may be inserted through a shear pin collar 810 into a shear pin ring 812. A number of shear pins 808, for example, four, may be arranged radially about the longitudinal axis of shock absorber 800. The shear pin collar 810 may be integral or separate from other parts of the shock absorber. The shear pin 808 may be a self-setting screw type pin or shear pin 808 optionally may be secured by a set screw 814. Other threshold force securing mechanisms can be used in combination with, or instead of, a shear pin. For example, a securing mechanism such as a brake pad, a counterweight, or other counter-force may be used. The threshold force securing mechanism allows the shock absorber 800, without expanding from its compressed state, to assist the support 400 in pulling capture net 500 taut. The shock absorber 800 on the other side of roadway 10, in an identical configuration, will assist the other corresponding support 400 in pulling the other side of the capture net 500 taut.

Capture net 500 may be installed with a pre-tension horizontal load, for example, 1,000-20,000 pounds, on its cables. This load will depend on a number of factors including, but not limited to, the length of capture net 500, the desired height of capture net 500, and construction and materials of the capture net 500.

When a vehicle 30 collides with capture net 500, the vehicle deflects the capture net 500, causing it to exert a tensile force exceeding the minimum threshold force upon shock absorber 800. When the threshold force securing mechanism includes shear pins 808, the tensile force causes the shear pins 808 to shear and thereby permits the expansion of piston 804 of shock absorber 800 against the resistance of the hydraulic fluid in cylinder 816 (FIG. 8B). Shock is thereby absorbed during its expansion, while the force of the capture net 500 may rotate shock absorber 800 and bearing sleeve 330, and may cause joint 700 to pivot about a horizontal axis. Forces applied upon capture net 500 are thereby translated through the center of stanchion 300, which is solidly anchored in foundation 320. Therefore, energy may be distributed among and absorbed by capture net 500, the shock absorbers 800, joint 700 and the stanchion 300.

Figure 9A:
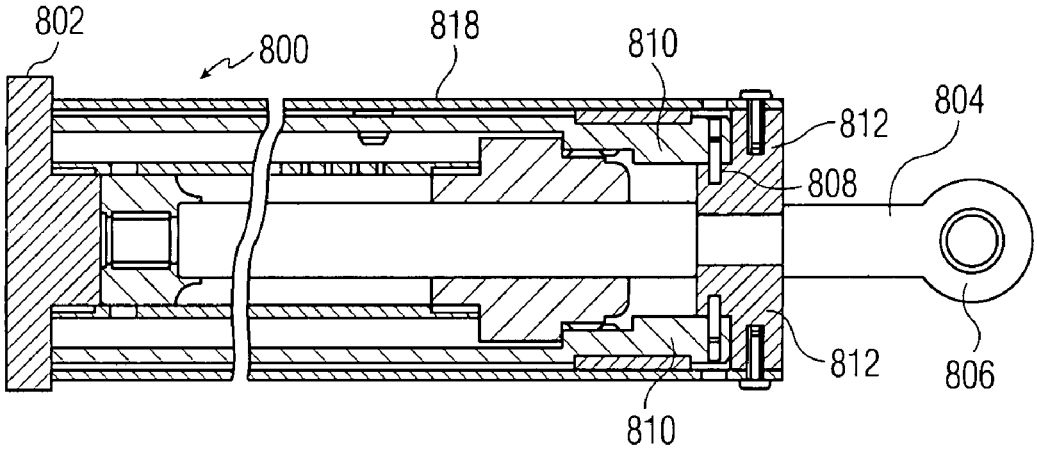
FIG. 9A is a side view of a shock absorber in a compressed state according to one aspect of the system of the present disclosure.
Figure 9B:
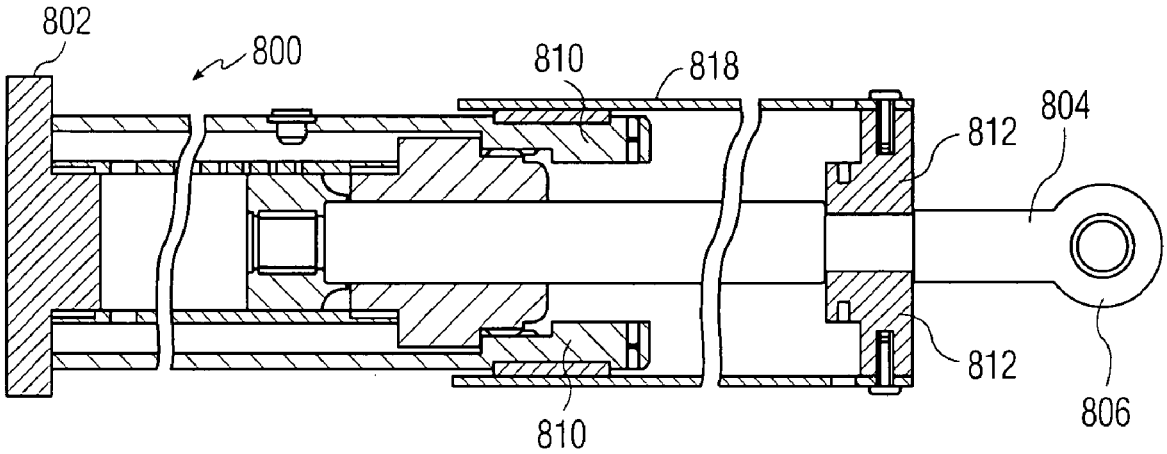
FIG. 9B is a side view of a shock absorber in an expanded state according to one aspect of the system of the present disclosure.

The shock absorbing mechanism may alternatively include a torque protection structure as illustrated in FIGS. 9A and 9B, which show side views in a compressed and expanded state, respectively. According to this aspect, shock absorbers 800 include a protective sleeve 818 which may be coupled to and travel with piston 804 in order to add structural strength to resist deformation of the housing or other parts of the shock absorber 800 due to the torque that the capture net 500 exerts upon capturing a vehicle and deflecting shock absorbers 800. The protective sleeve 818 may be made of any suitable structural material, for example, aluminum or steel.

Figure 10:
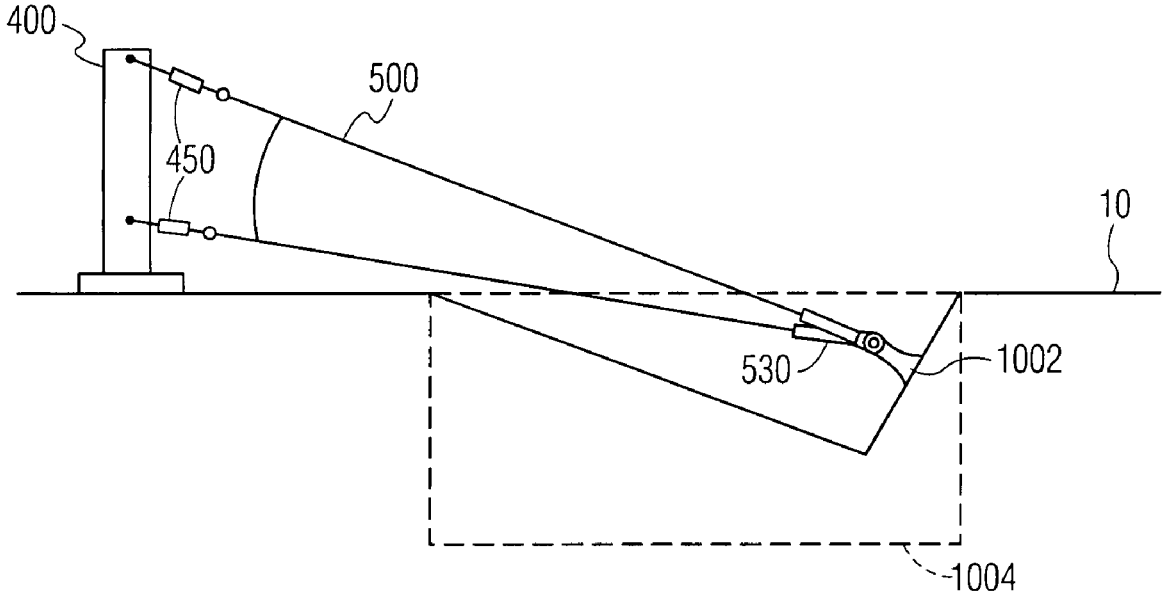
FIG. 10 is a side view which illustrates an energy absorbing system with support arranged at a roadway according to one aspect of the system of the present disclosure.

FIG. 10 is a side view which illustrates an energy absorbing system with support 400 arranged at a roadway according to one aspect of the system of the present disclosure. Net 500 is connected to an anchor, for example, a tie back 1002, which may be located above, at, or below ground level. In the aspect shown, cable ends 530 of top cable 510 and bottom cable 520 are each coupled to tie back 1002 which is embedded below ground level in concrete 1004 alongside roadway 10. In another aspect, each of top cable 510 and bottom cable 520 may be coupled to a separate tie back 1002. In another aspect, tie back 1002 may be coupled to net 500 via a socket (not shown).

Figure 11:
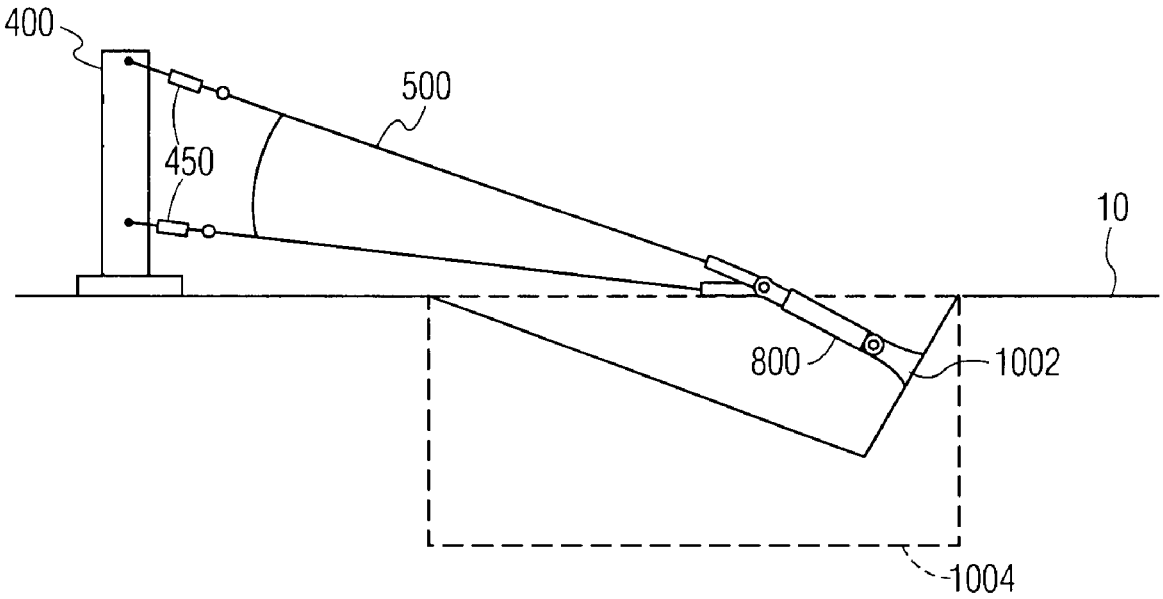
FIG. 11 is a side view which illustrates an energy absorbing system with support arranged at a roadway according to one aspect of the system of the present disclosure.

FIG. 11 is a side view which illustrates an energy absorbing system with support 400 arranged at a roadway according to one aspect of the system of the present disclosure. Net 500 is coupled to a shock absorber 800 which is coupled to an anchor, for example, a tie back 1002, which may be located above, at, or below ground level. In the aspect shown, cable ends 530 of top cable 510 and bottom cable 520 are each coupled to shock absorber 800 which is coupled to tie back 1002 which is embedded below ground level in concrete 1004 alongside roadway 10. In another aspect, each of top cable 510 and bottom cable 520 may be coupled to any combination of shock absorbers 800 and tie backs 1002.

An embodiment similar to that shown in FIGS. 1 and 2 was constructed as follows. It will be apparent to one skilled in the art that size and thickness of the materials used will vary based on, for example, the expected potential energy encountered by the system, determined by such factors as the expected size and velocity of the vehicles to be arrested.

The overall width of the installation was 12 feet centerline to centerline of the stanchions 300. The capture net 500 width was 25 feet, and included top cable 510, bottom cable 520 and center cable 550 spaced 1.5 feet apart and coupled by seven vertical cables 540 spaced 1.5 feet apart. The uninstalled constructed capture net 500 height was 3 feet. The height of the capture net 500 when installed and tensioned was 50.25 inches to the center of the top cable and 15.75 inches to the center of the bottom cable as measured at the centerline of the capture net 500. The top cable 510 and bottom cable 520 were 1.25 inch 6×26 galvanized MBL 79 tons, the vertical cables 540 and center cable 550 were ⅝ inch 6×26 galvanized MBL 20 tons, and the vertical cables 540 were coupled to the top cable 510 and bottom cable 520 by swage sockets. Cable ends 530 were also swage sockets.

Cable ends 530 of top cable 510 and bottom cable 520 were coupled to the stanchion 300 via shock absorber 800, joint 700 and bearing sleeve 330 at points 2 feet 10 inches and 1 feet 7 inches as measured from ground level to the cable center point, respectively.

In an aspect where shock absorbers 800 are not present, top cable 510 and bottom cable 520 may be, for example, 1.5 inch thickness, and center cable 550 and vertical cables 540 may be ¾ inch thickness.

In another aspect a 50 foot capture net 500 may be used for a 36 foot distance between stanchions 300, which may include top cable 510, bottom cable 520 and center cable 550 spaced 1.5 feet apart coupled by twenty-three vertical cables 540 spaced 1.5 feet apart.

The supports 400 were located 13 feet in front of, and 3 feet to the outside of the stanchions 300, with a pole 402 height of 4 feet 8 and ⅝ inches and top securing height of 4 feet 7 inches and bottom securing height of 1 feet 8 inches.

Concrete base size may vary by installation and application. In the embodiment constructed, the hole used for the concrete base 320 was measured as 15 feet in direction vehicle 30 was traveling, 27 feet between stanchions 300 and 3.5 feet deep.

The spring 424 used had 1000 ft lbs torque, an inner diameter of 9 inches and an outer diameter of 11 inches. Joint front flange 702 included four holes for bolting to shock absorber flange 802. Joint rear flange 720 was welded to bearing sleeve 330. Pin 712 had a length of 10 and ¾ inches and diameter of 2 and ⅜ inches.

The shock absorbers 800 used were hydraulic with about a 130,000 pound resistance with a 36 inch stroke and had an accumulator with a 5,000 pound return force for use with a 15,000 pound, 50 mph vehicle impact. The length of shock absorber 800 was 97 inches extended and 61 inches compressed, with a diameter of 10.8 inches.

Stanchion 300 included a 2 inch thick steel pipe, which had a 16 inch outside diameter and was 94 inches long. The stanchion 300 was reinforced by inserting a 4 inch thick steel bar, which had a width of 11.3 inches and length of 94 inches.

Stanchion was filled with concrete and was embedded approximately 3.5 feet deep below ground level and extended approximately 3.8 feet above ground level.

Bearing sleeve 330 was 31" long. Bearing sleeve clamp 600 had an outside diameter of 18 inches. Sleeve clamp flange 604 included two holes 606 to accommodate two bolts for tightening about stanchion 300. Bearing sleeve clamp 600 had an inner diameter of 16 inches and was fabricated of the same material as bearing sleeve 330.

Numerous additional modifications and variations of the present disclosure are possible in view of the above-teachings. It is therefore to be understood that within the scope of the appended claims, the present disclosure may be practiced other than as specifically described herein.

The invention claimed is:

1. An energy absorbing system comprising:

a first anchor and a second anchor, located on opposite sides of a roadway;

a net mechanically coupled to each of the first and second anchors and spanning the roadway;

a first raising/lowering arm arranged on one side of the roadway, the first raising/lowering arm mechanically coupled to and supporting an upper portion of the net via a first upper frangible tensioner and mechanically coupled to and supporting a lower portion of the net via a first lower frangible tensioner;

a second raising/lowering arm arranged on another side of the roadway, the second raising/lowering arm mechanically coupled to and supporting an upper portion of the net via a second upper frangible tensioner and mechanically coupled to and supporting a lower portion of the net via a second lower frangible tensioner, wherein the first and second upper and first and second lower frangible tensioners decouple from the net upon application of a predetermined force.

2. The energy absorbing system of claim 1, wherein when the first and second raising/lowering arms are in a raised position, the first and second upper frangible tensioners are arranged at a height above a surface of the roadway such a upper portion of the net is at or above a bumper of a vehicle.

3. The energy absorbing system of claim 2, wherein when the first and second raising/lowering arms are in a raised position, the first and second lower frangible tensioners are arranged at a height above the surface of the roadway such that a lower portion of the net is at or below the bumper of the vehicle.

4. The energy absorbing system of claim 1, wherein the frangible tensioners decouple the raising/lowering arms from the net when a vehicle impacts the net.

5. The energy absorbing system of claim 1, wherein the net weighs at least 1000 lbs.

* * * * *